US012221197B1

(12) United States Patent
Raffini

(10) Patent No.: US 12,221,197 B1
(45) Date of Patent: Feb. 11, 2025

(54) HYDRO CYCLE

(71) Applicant: Roger Raffini, Wilton, CT (US)

(72) Inventor: Roger Raffini, Wilton, CT (US)

( * ) Notice: Subject to any disclaimer, the term of this patent is extended or adjusted under 35 U.S.C. 154(b) by 0 days.

(21) Appl. No.: 18/915,085

(22) Filed: Oct. 14, 2024

Related U.S. Application Data

(60) Provisional application No. 63/666,525, filed on Jul. 1, 2024.

(51) Int. Cl.
*B63H 16/20* (2006.01)
*B63B 34/50* (2020.01)

(52) U.S. Cl.
CPC ..... *B63H 16/20* (2013.01); *B63B 34/50* (2020.02); *B63H 2016/202* (2013.01)

(58) Field of Classification Search
None
See application file for complete search history.

(56) References Cited

U.S. PATENT DOCUMENTS 424,026 A * 3/1890 Riexinger ..... B63H 16/14 440/90
477,160 A * 6/1892 Vogt ..... B63H 16/14 440/30
557,647 A * 4/1896 Boulter ..... B63H 16/14 440/90
5,921,824 A * 7/1999 Ilagan ..... B63H 16/12 440/26
7,232,350 B1 * 6/2007 Krah ..... B63B 32/64 440/35
8,043,134 B2 * 10/2011 Krah ..... B63H 16/12 440/32
9,533,746 B1 * 1/2017 Garrett ..... B63H 1/16
2012/0244760 A1 * 9/2012 Ekhoff ..... B63H 1/04 440/90
2015/0087195 A1 3/2015 Hansen

FOREIGN PATENT DOCUMENTS

CH 714233 A2 * 4/2019 ..... B63B 32/00
EP 2070814 B1 * 12/2016 ..... B63B 7/04

OTHER PUBLICATIONS

Hydrofoil, Decavitator & Drela, Mark & Schafer, Marc & Wall, Matt. (1995). Decavitator Human-Powered Hydrofoil.

* cited by examiner

*Primary Examiner* — S. Joseph Morano
*Assistant Examiner* — Jovon E Hayes

(57) ABSTRACT

A human-powered watercraft. The watercraft comprises a floatation element, a frame, a seat, a paddle wheel, a compression channel, and a steering mechanism. The paddle wheel is driven by a set of pedals, operated by the rider. A chain and sprocket system connects the pedals to the paddle wheel. The compression channel increases thrust produced by the paddle wheel. The steering mechanism is controlled by a handlebar and implements a bow swivel float as a rudder. The watercraft optionally includes a pontoon gear.

20 Claims, 17 Drawing Sheets

HYDRO CYCLE

FIELD OF THE INVENTION

The present invention relates generally to watercraft. The present invention relates more specifically to human-powered watercraft.

BACKGROUND OF THE INVENTION

MIT set the speed record for a human-powered watercraft of 21.3 mph on Oct. 27, 1991, using a craft called the "Decavitator." The Decavitator used an aerial propeller, which generated minimal traction.

It is an objective of the present invention to provide a watercraft capable of surpassing the MIT speed record. It is an objective of the present invention to use thrust flow of water to maximum traction and propulsion by directing water discharge. It is an objective of the present invention to provide opportunities for recreation, fitness, and environmentally friendly transportation.

SUMMARY OF THE INVENTION

A human-powered hydro cycle. The hydro comprises a floatation element, a frame, a seat, a paddle wheel, a compression channel, and a steering mechanism. The paddle wheel is driven by a set of pedals, operated by the rider. A chain and sprocket system connects the pedals to the paddle wheel. The compression channel increases thrust produced by the paddle wheel. The steering mechanism is controlled by a handlebar and implements a bow swivel float as a rudder. The watercraft optionally includes a pontoon gear.

DETAILED DESCRIPTION OF THE INVENTION

All illustrations of the drawings are for the purpose of describing selected versions of the present invention and are not intended to limit the scope of the present invention.

The present invention comprises a hydro cycle. The hydro cycle comprises a floatation element equipped with a frame, a seat, a propulsion system, and a steering mechanism. The hydro cycle is optionally equipped with a pontoon gear. The pontoon gear provides additional stability to the hydro cycle, and the pontoon gear can be lifted out of the water to reduce drag when the hydro cycle is in motion. The pontoon gear performs a function analogous to a kick stand or training wheels on a bicycle.

Figure 1:
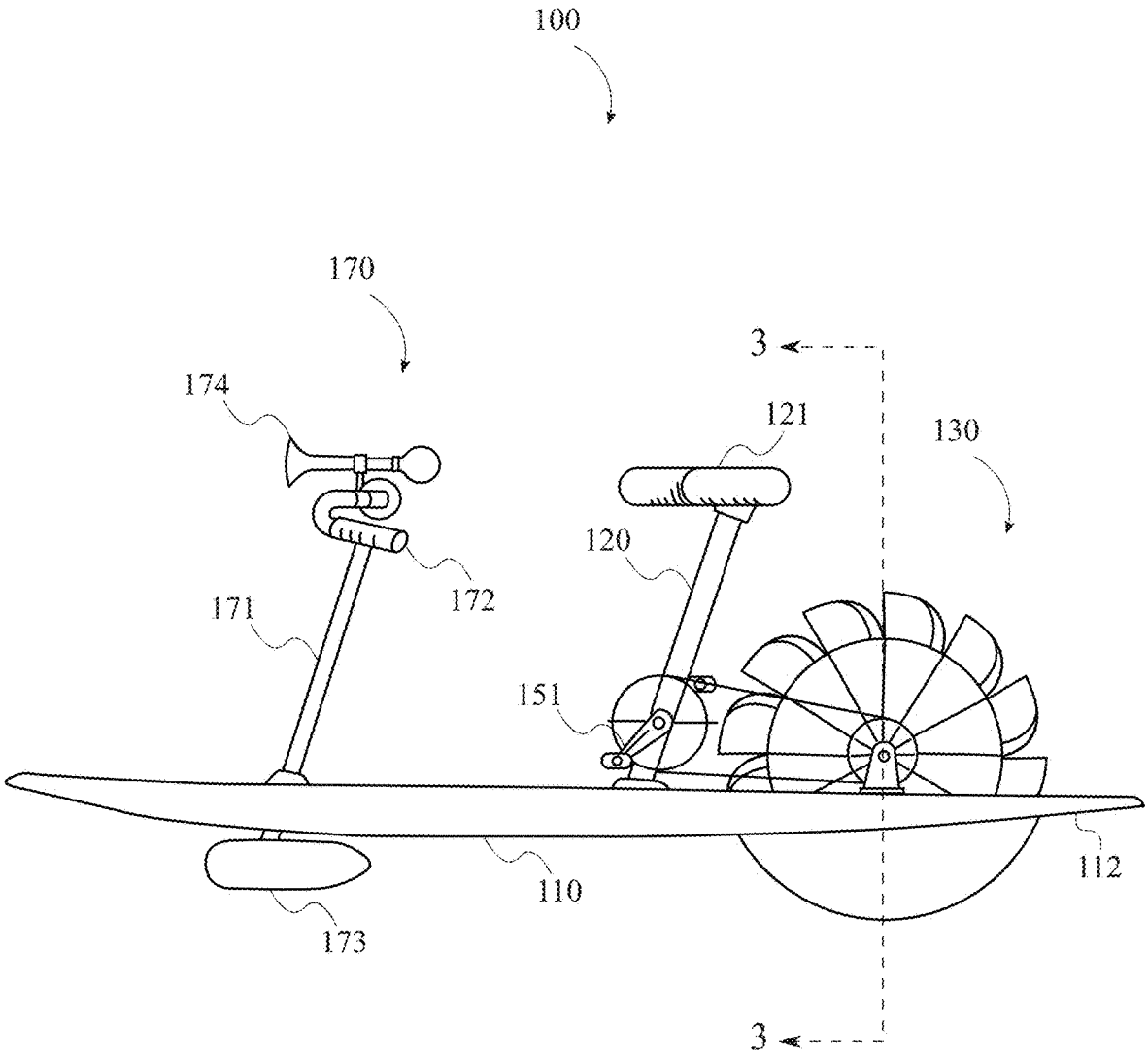
FIG. 1 is a right-side elevation view of Embodiment 1 of the present invention. Line 3-3 shows the plane of a sectional view shown in FIG. 3.
Figure 2:
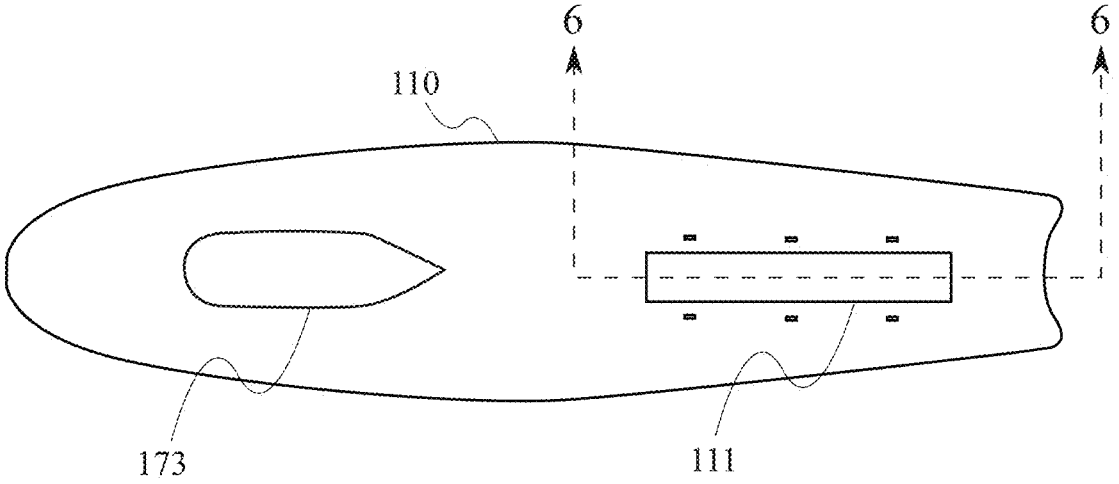
FIG. 2 is a bottom plan view of Embodiment 1 of the present invention. Line 6-6 shows the plane of a section view shown in FIG. 6.
Figure 3:
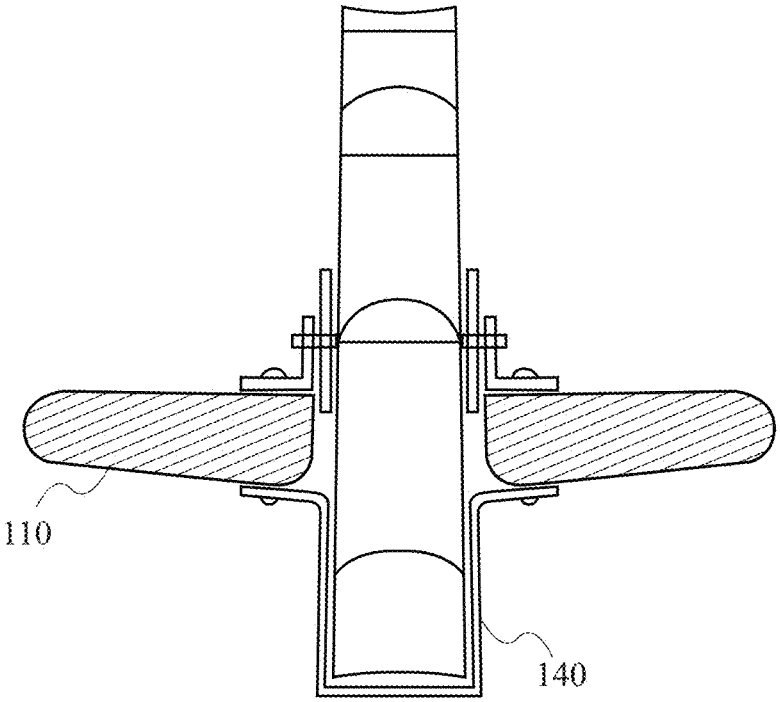
FIG. 3 is a front sectional view of Embodiment 1 of the present invention taken along line 3-3 in FIG. 1.
Figure 4:
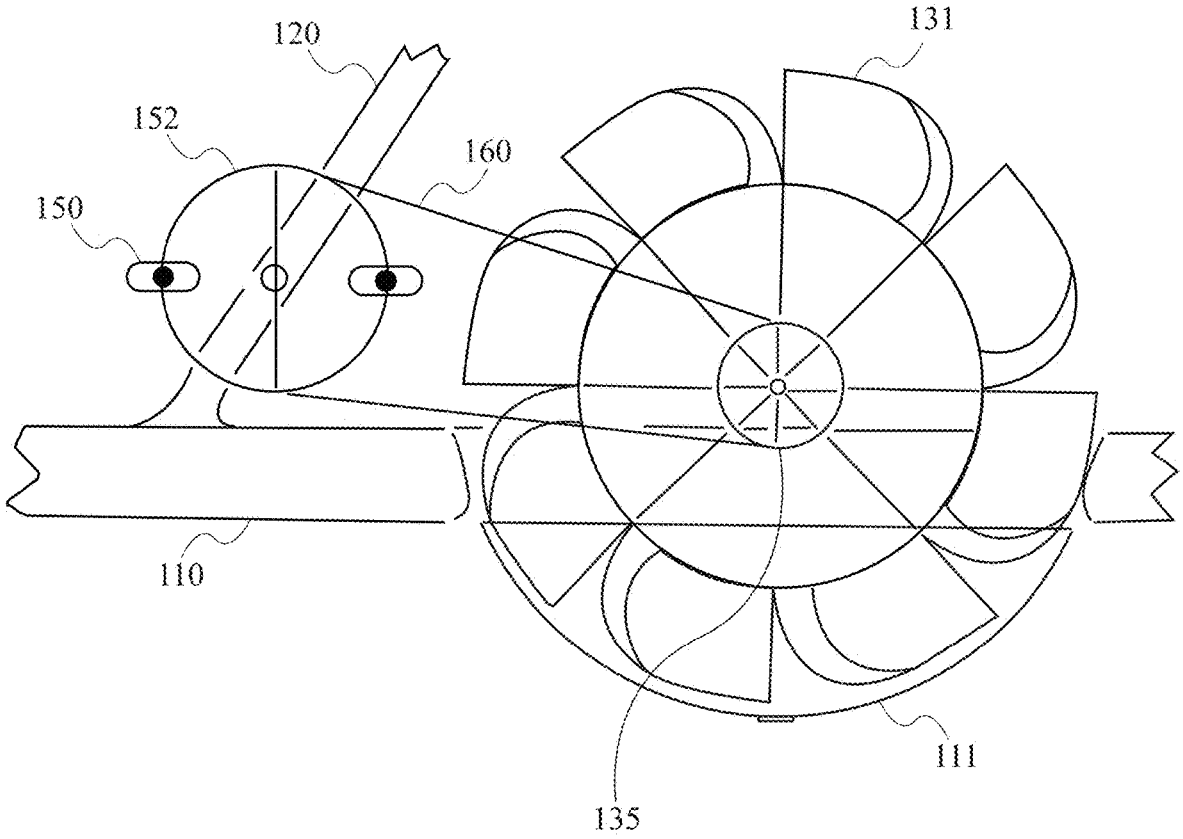
FIG. 4 is a right-side elevation view of the propulsion system of Embodiment 1 of the present invention.
Figure 5:
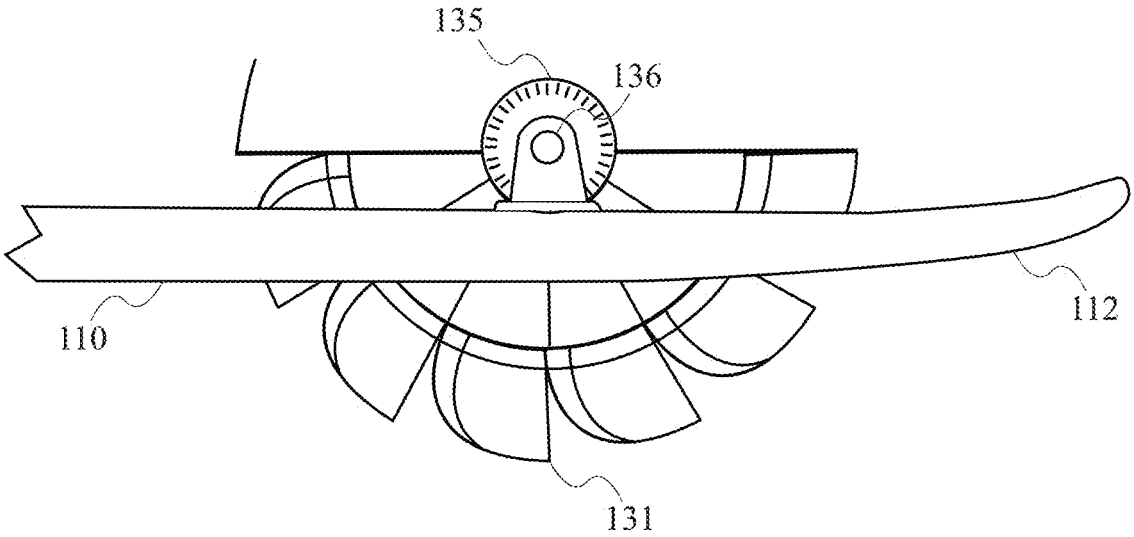
FIG. 5 is a right-side elevation view of the propulsion system of Embodiment 1 of the present invention.
Figure 6:
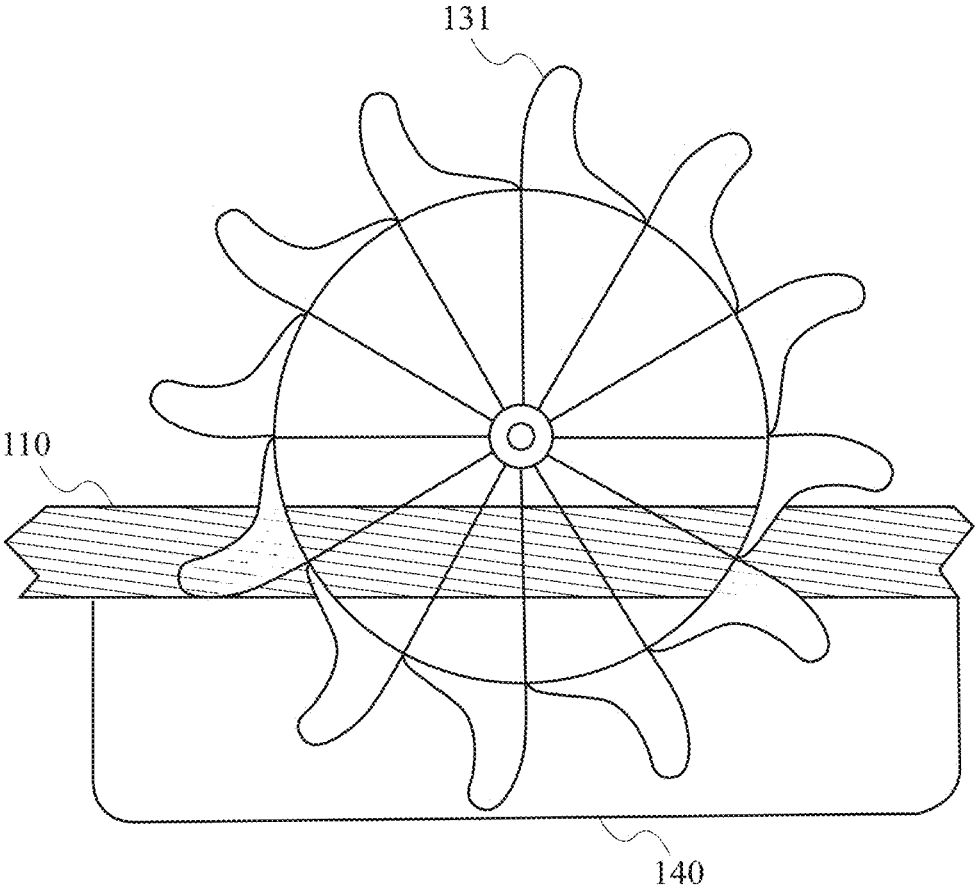
FIG. 6 is a right-side sectional view of the propulsion system of Embodiment 1 of the present invention taken along line 6-6 in FIG. 2.
Figure 7:
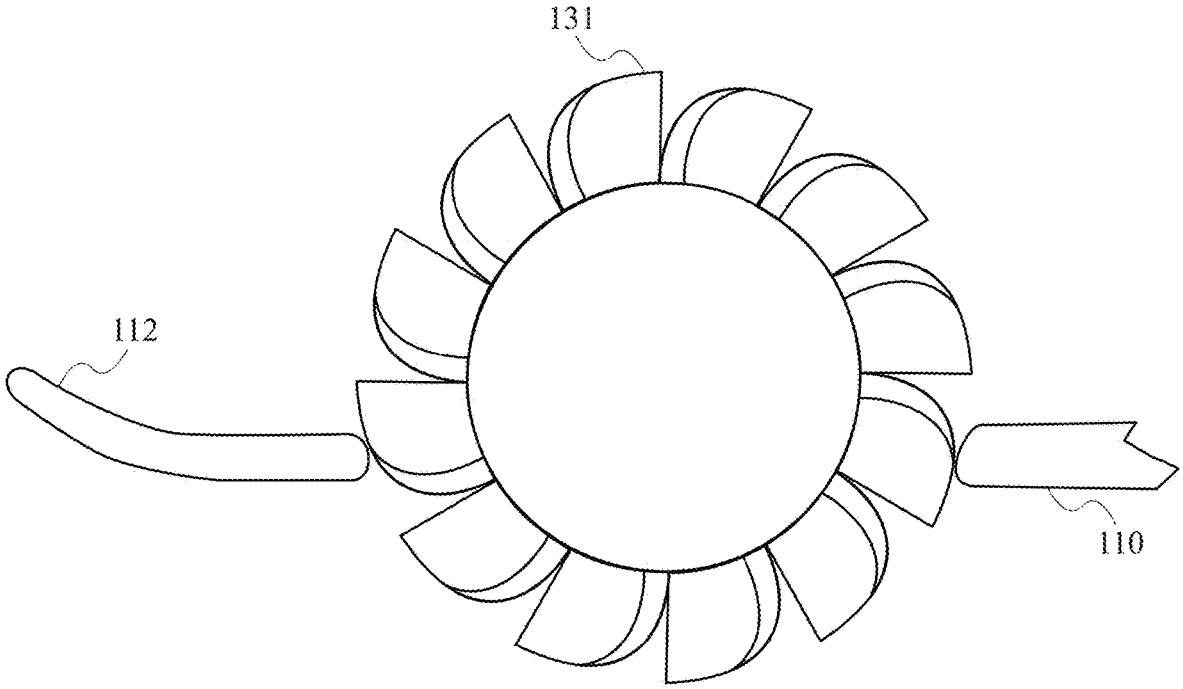
FIG. 7 is a left-side elevation view of the propulsion system of Embodiment 1 of the present invention.
Figure 8:
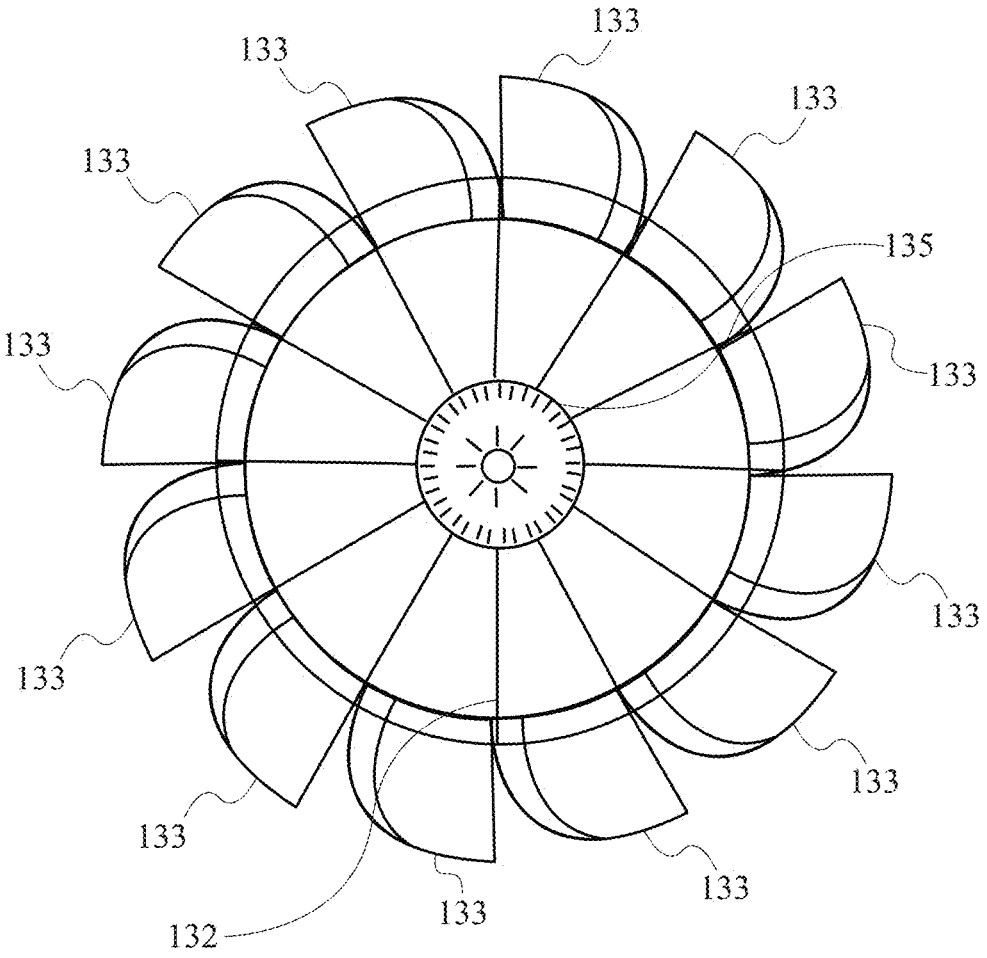
FIG. 8 is a right-side elevation view of the paddle wheel of Embodiment 1 of the present invention.
Figure 9:
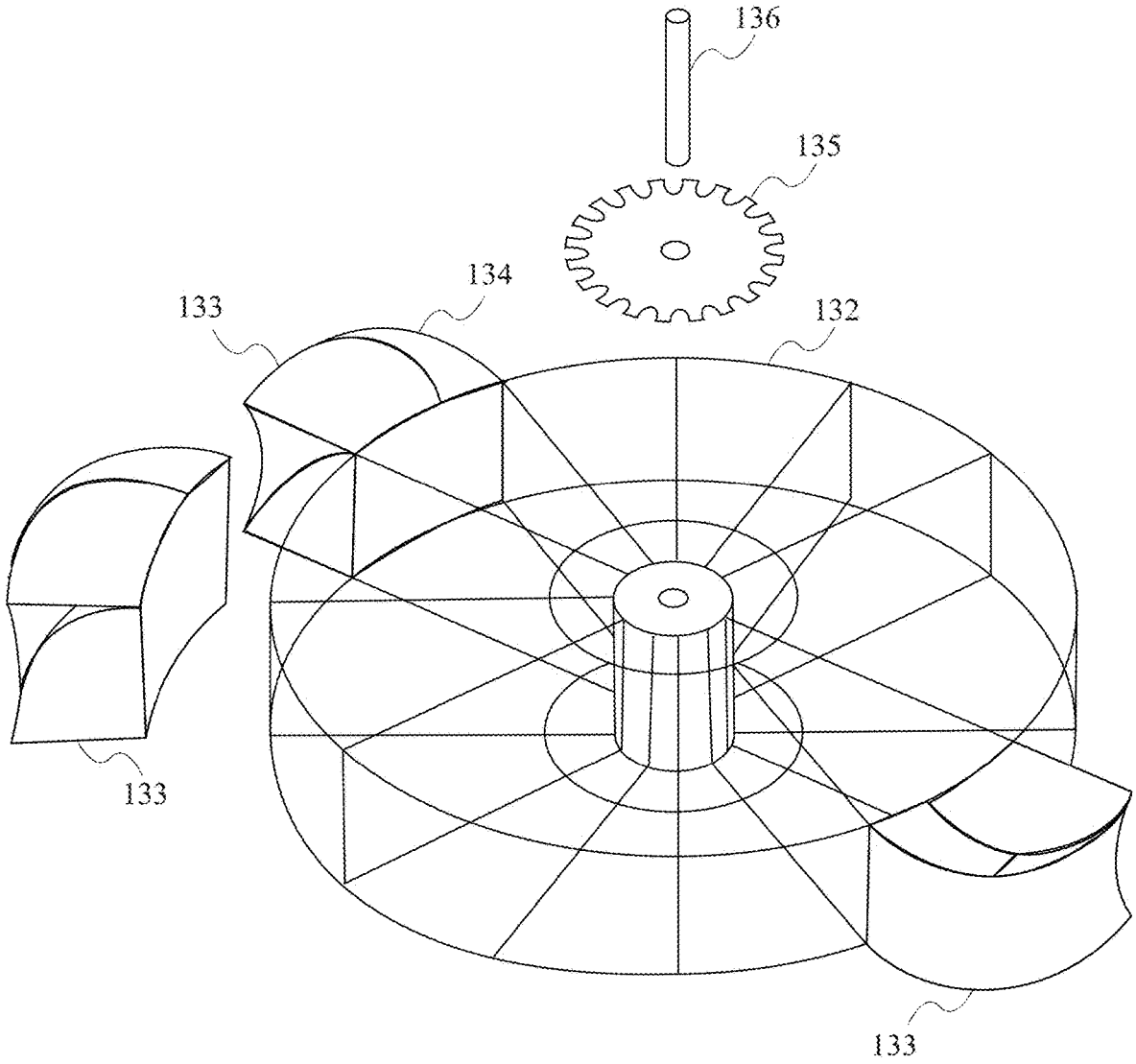
FIG. 9 is an exploded view of the paddle wheel of Embodiment 1 of the present invention.
Figure 10:
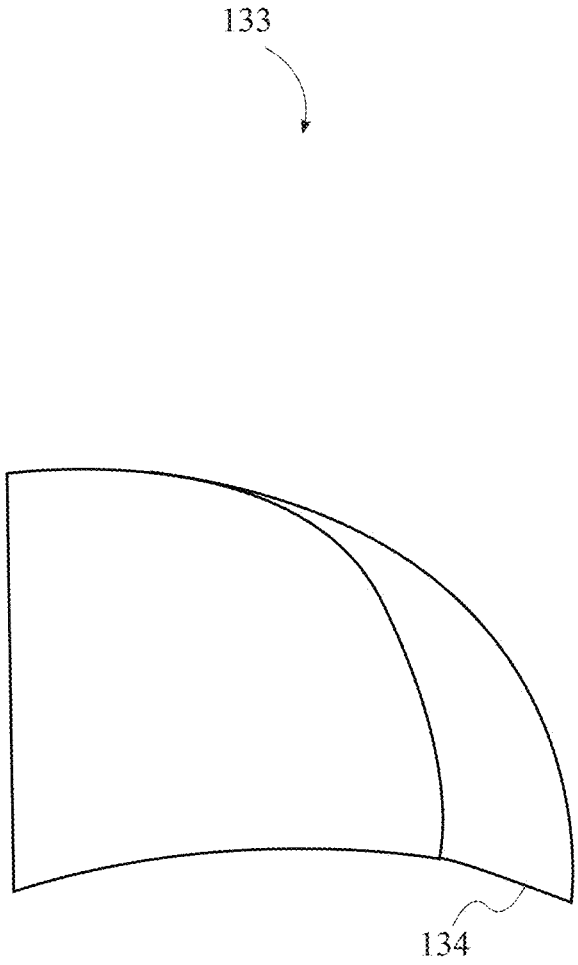
FIG. 10 is a right-side elevation view of a propulsion cup of Embodiment 1 of the present invention.
Figure 11:
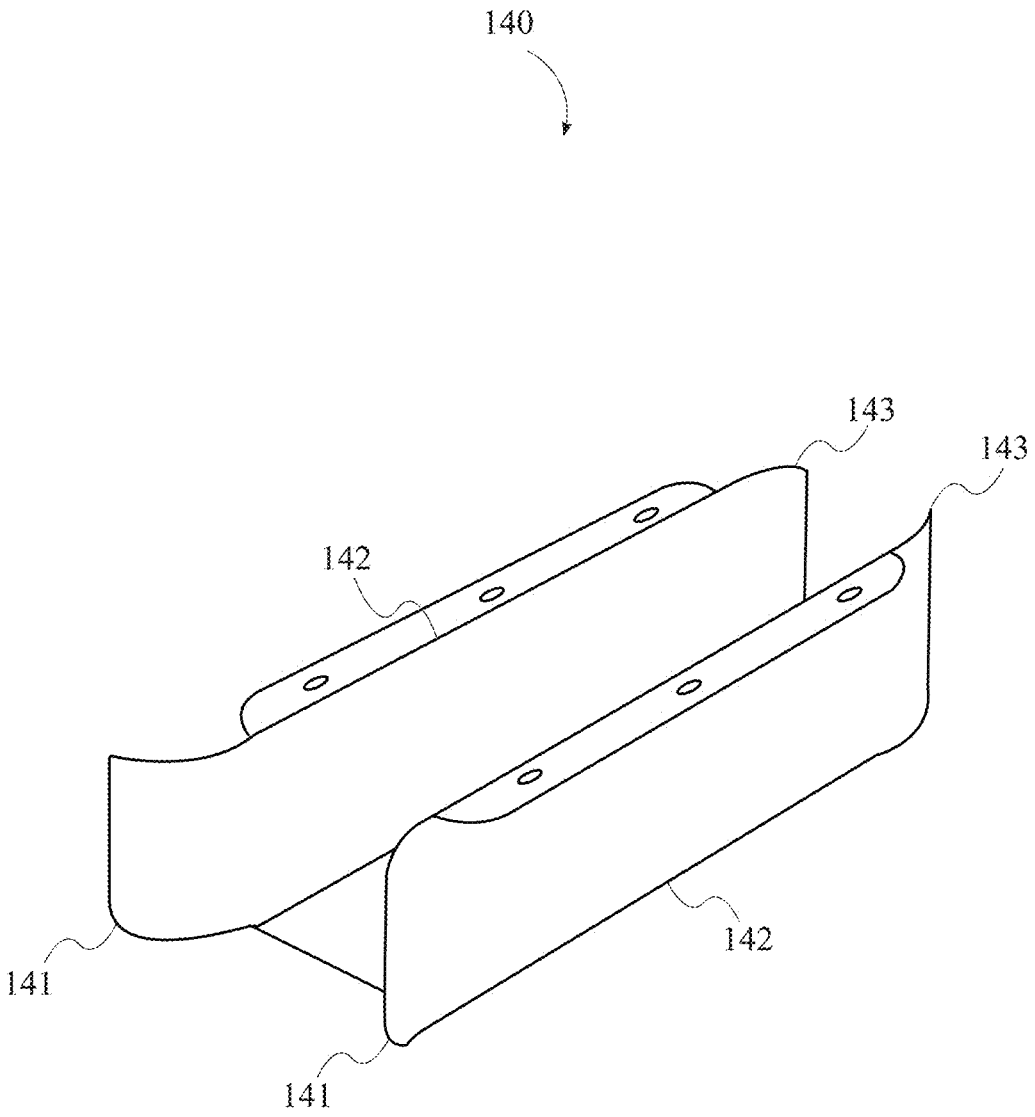
FIG. 11 is a perspective view of the compression channel of Embodiment 1 of the present invention.
Figure 12:
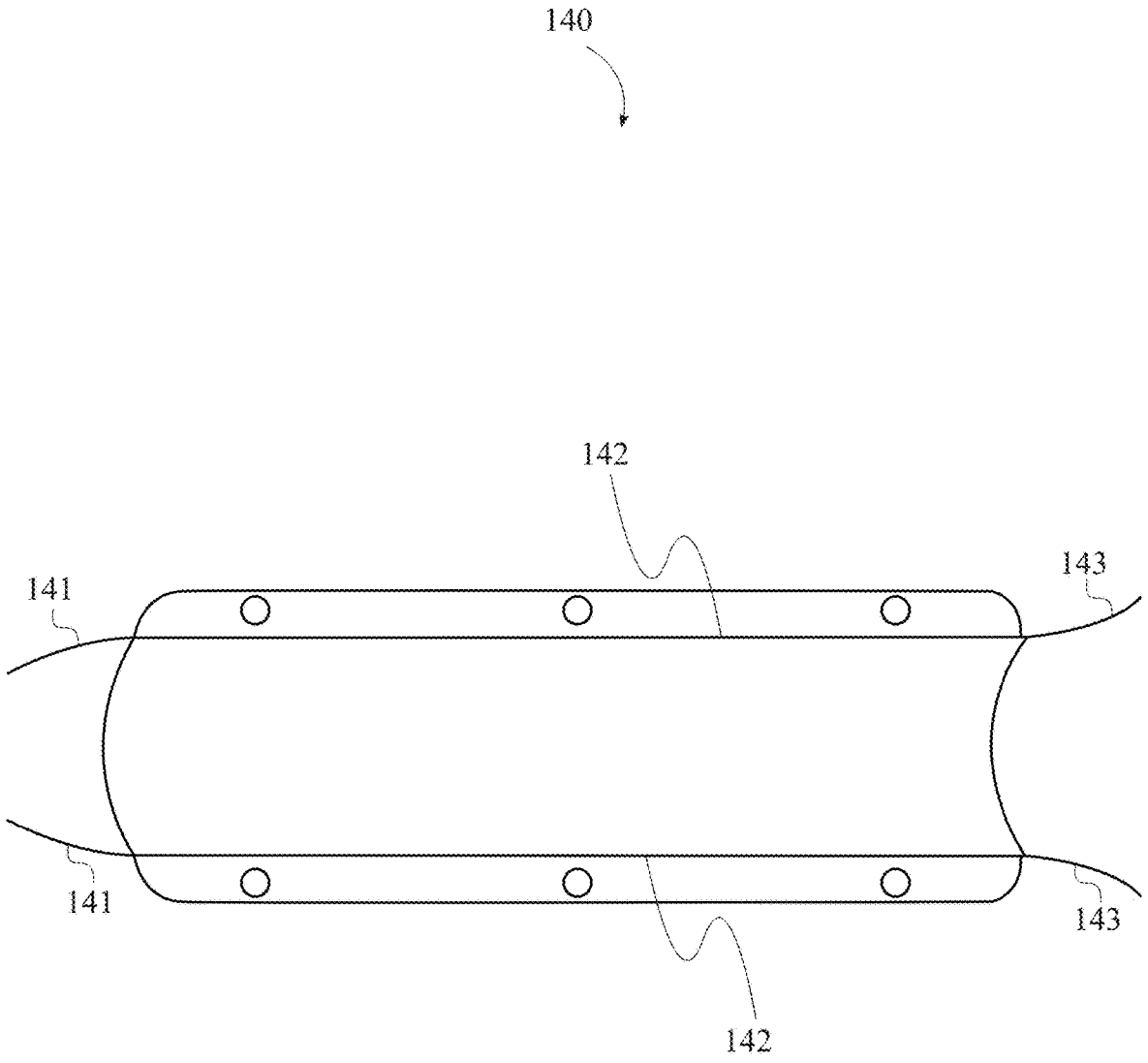
FIG. 12 is a top plan view of the compression channel of Embodiment 1 of the present invention.
Figure 13:
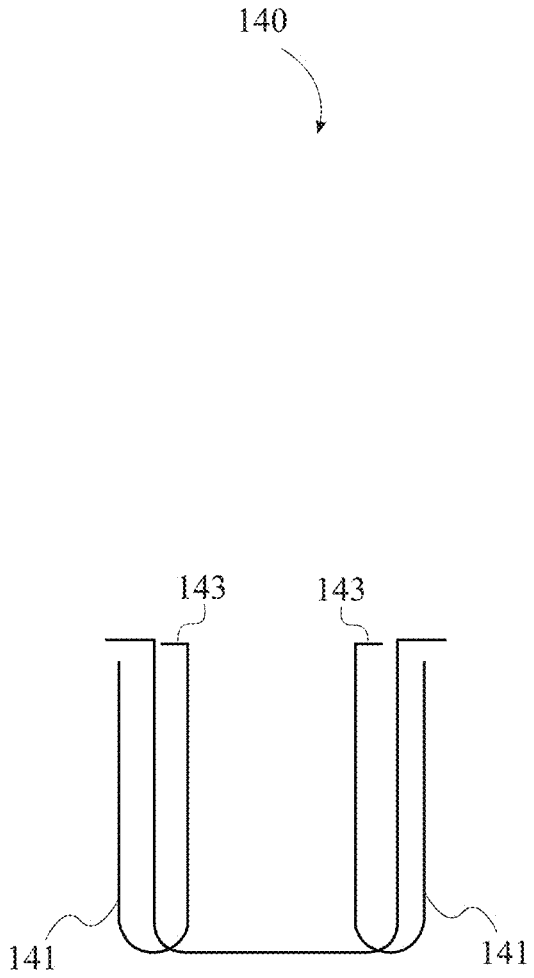
FIG. 13 is a front elevation view of the compression channel of Embodiment 1 of the present invention.

Referring to FIGS. 1-13, Embodiment 1 of the present invention comprises a hydro cycle 100. The hydro cycle 100 comprises a floatation element 110, a frame 120, a seat 121, a propulsion system 130, and a steering mechanism 170. The floatation element 110 is a surfboard-style floatation device. In alternate embodiments, the floatation element 110 may have other shapes. The floatation element 110 includes a wheel well 111 and a tail shield 112. The wheel well 111 surrounds a lower portion of the paddle wheel 131. The tail shield 112 is located aft of the wheel well 111. The tail shield 112 aids the flow of water thrust exiting the compression channel 140 by physically blocking vertical sprays of water, known as "rooster tails." The frame 120 is mounted to the top of the floatation element 110. A seat 121 for the rider is mounted to the top of the frame.

The propulsion system 130 comprises a paddle wheel 131, compression channel 140, a set of pedals 150, and a set of chains 160. The paddle wheel 131 is mounted to an axle 136. The axle 136 of the paddle wheel 131 is mounted to the floatation element 110. The lower portion of the paddle wheel 131 sits within the wheel well 111. The paddle wheel 131 comprises a paddle wheel frame 132 and propulsion cups 133. The propulsion cups 133 are mounted around the perimeter of the paddle wheel frame 132. In embodiment 1, twelve propulsion cups 133 are mounted to the paddle wheel frame 132. In alternate embodiments, different numbers of propulsion cups 133 may be used. Each propulsion cup 133 comprises a open front and an closed back. The roof of each propulsion cup 133 is arched inward at the front opening. Each propulsion cup 133 comprises an expulsion vent 134 on the left side and the right side of the propulsion cup 133. As the paddle wheel 131 rotates, the propulsion cups 133 push the water backwards, propelling the hydro cycle 100 forward. As the propulsion cups 133 are raised out of the water, the expulsion vents 134 allow air and water to exit the propulsion cups 133, reducing drag on the propulsion cups 133. The expulsion vents 134 are sealed by the lateral braces 142 of the compression channel 140 as the propulsion cup passes through the water. A rear sprocket 134 is mounted to left side and the right side of the axel 136 of the paddle wheel 131.

The compression channel 140 is mounted to the floatation element 110 below the wheel well 111. The compression channel 140 comprises front scoops 140 on the left side and the right side, lateral braces 142 on the left side and the right side, and tail pinches 143 on the left side and the right side. The compression channel 140 increases the pressure of water exiting through the tail pinches 143. The increased water pressure increases the velocity of the water exiting the compressing channel 140, thereby increasing the thrust force of the paddle wheel 140. As a propulsion cup 133 passes into the compression channel 140, the lateral braces 142 seal the expulsion vents 134, preventing water from escaping through the expulsion vents 134 while the propulsion cup 133 is inside the compression channel.

The set of pedals 150 are mounted to the frame 120. Each pedal 150 is connected to a crank arm 151. Front sprockets 152 are mounted to the left crank arm 151 and the right crank arm 151. A set of chains 160 connect the front sprockets 152 to the rear sprockets 135 A left chain 160 connects the left front sprocket 152 to the left rear sprocket 135. A right chain 160 connects the right front sprocket 152 to the right rear sprocket 135. In alternate embodiments, a single chain or more than two chains may be used. As the rider moves the pedals 150, the pedals 150 drive the front sprockets 152. The front sprockets 152 drive the chains 160, and the chains drive the rear sprockets 135. The rear sprockets drive the paddle wheel 131. In alternate embodiments, a variable gearing mechanism may be used to vary the mechanical advantage provided by the pedals 150.

The steering mechanism 170 is mounted to the front of the floatation element 110. The steering mechanism 170 comprising a steering column 171, a handlebar 172, and a rudder 173. The steering column 171 traverses the floatation element 110. The steering column 171 transfers rotational movement from the handlebar 172 to the rudder 173. The handlebar 172 is mounted to the top of the steering column 171. The handlebar 172 provides the main steering control for the hydro cycle 100. The rudder 173 is mounted to the bottom of the steering column 171. In Embodiment 1, the rudder comprises a bow swivel float, which adds buoyancy to the bow of the hydro cycle 100 and permits steering control during hydroplaning. In some embodiments, a horn 174 is mounted to the handlebar 172.

The hydro cycle 100 includes various screws, bolts, nuts, adhesives, clamps and welds to connect or mount the various components.

Figure 14:
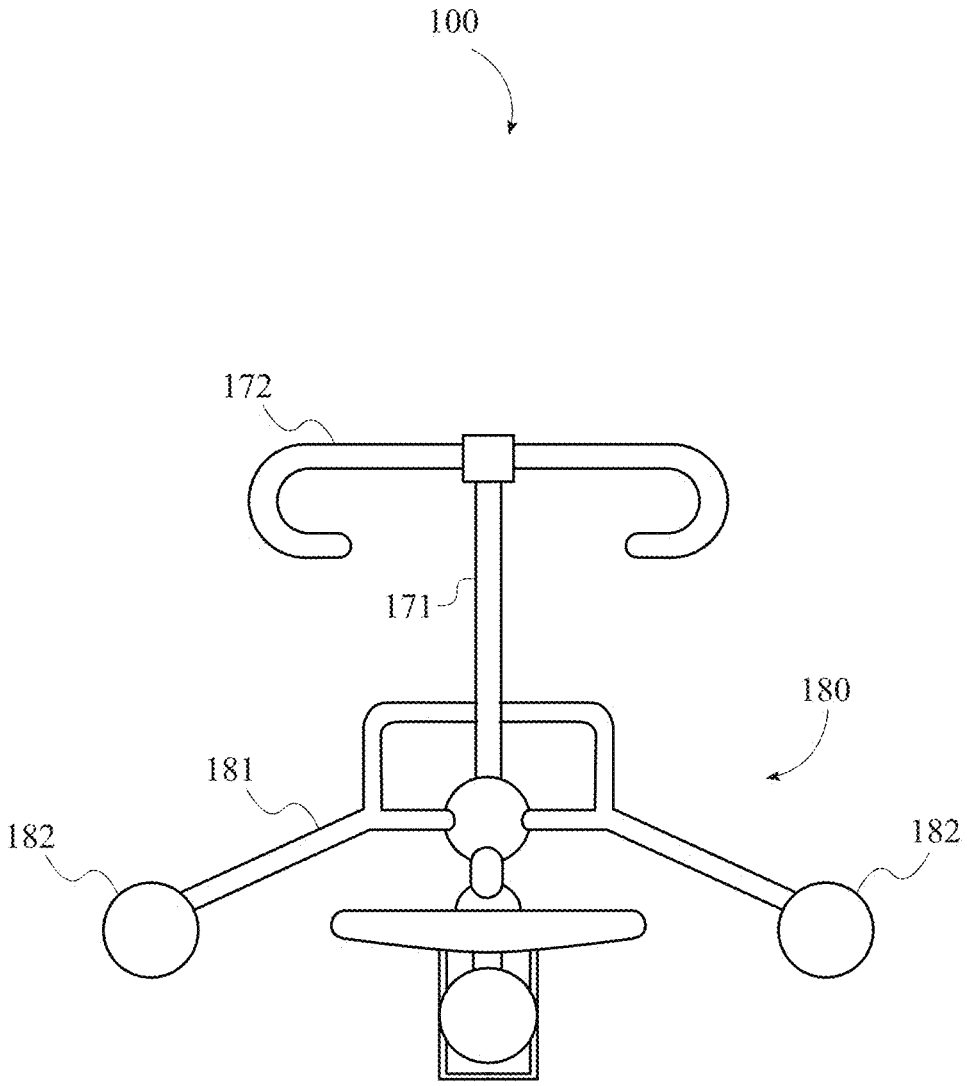
FIG. 14 is a front elevation view of Embodiment 2 of the present invention.
Figure 15:
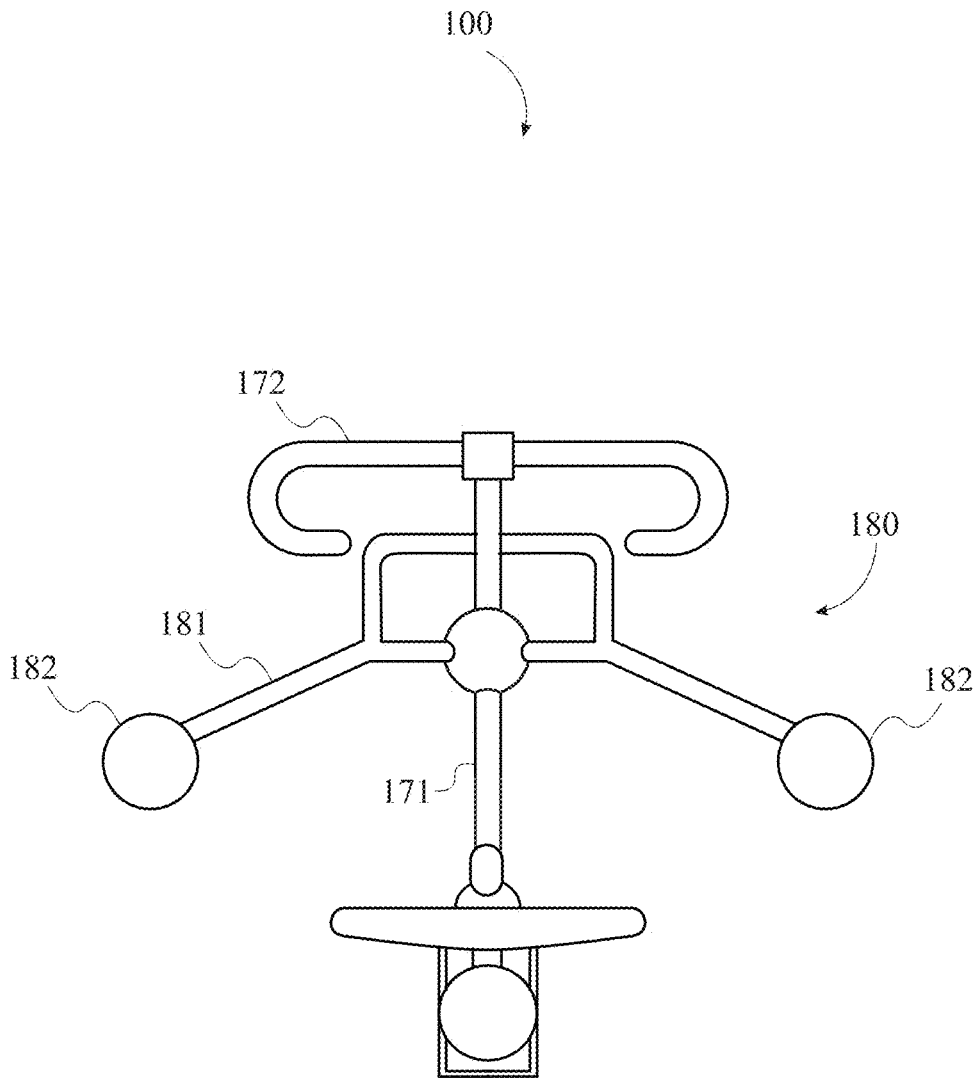
FIG. 15 is a front elevation view of Embodiment 2 of the present invention, showing an alternate position of the pontoon gear.
Figure 16:
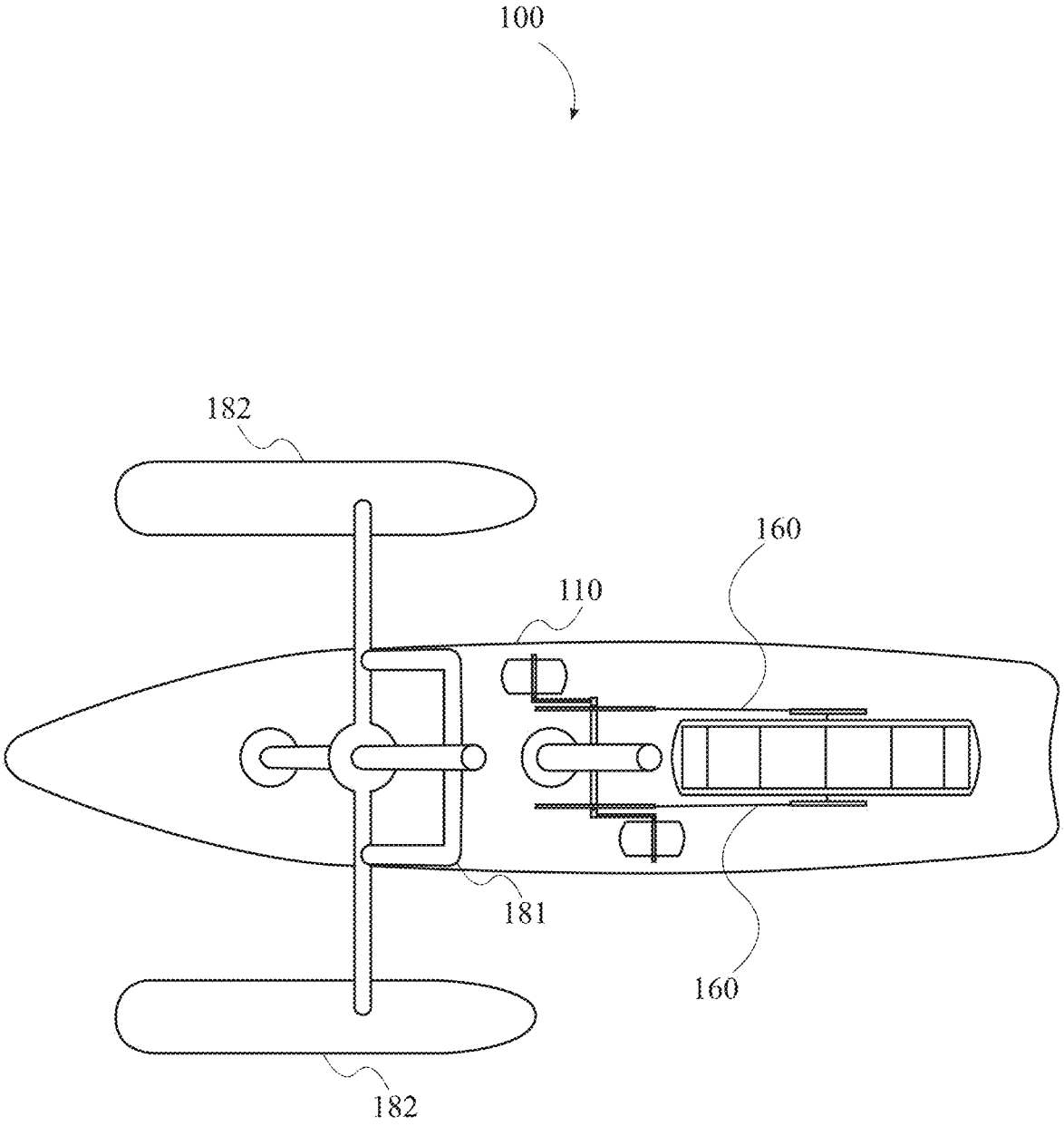
FIG. 16 is a top plan view of Embodiment 2 of the present invention.
Figure 17:
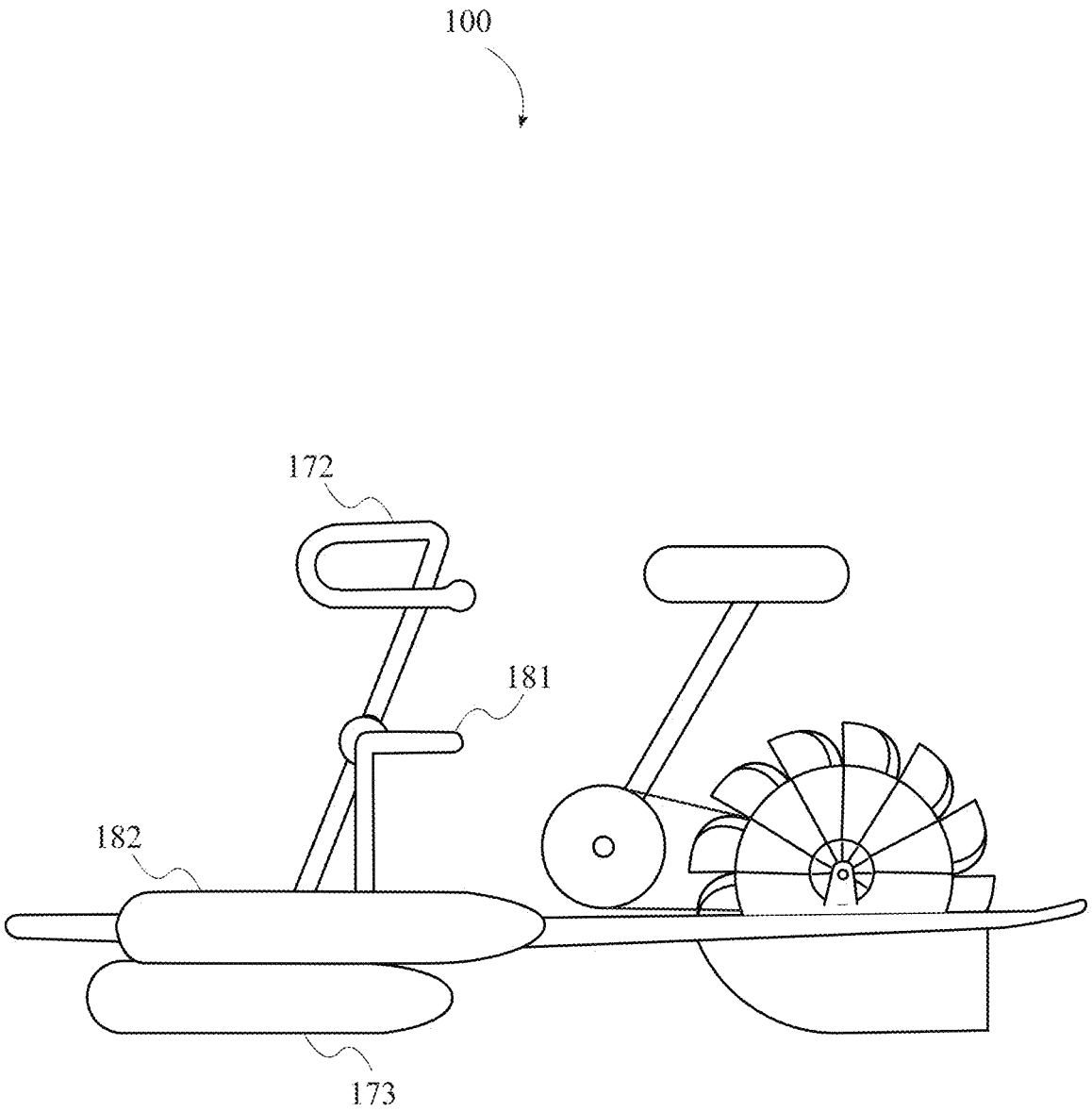
FIG. 17 is a right-side elevation view of Embodiment 2 of the present invention.

Referring to FIGS. 14-17, Embodiment 2 of the present invention comprises a hydro cycle. The hydro cycle comprises a floatation element 110, a frame 120, a seat 121, a propulsion system 130, a steering mechanism 170, and a pontoon gear 180. The floatation element 110, frame 120, seat 121, propulsion system 130, and steering mechanism 170 of Embodiment 2 are the same as in Embodiment 1, described above. The pontoon gear 180 comprises a pontoon gear frame 181 and pontoons 182. In Embodiment 2, the pontoon gear 180 comprises two pontoons 182, one pontoon 182 on the left side of the hydro cycle 100 and one pontoon 182 on the right side of the hydro cycle 100. In alternate embodiments, a single pontoon or more than two pontoons 182 may be used. The pontoon gear frame 181 connects to the steering column 171. The pontoon gear 180 is moveable along the steering column 171. The pontoon gear 180 may be lowered into the water to provide additional stability. The pontoon gear 180 may be raised out of the water to reduce drag when the hydro cycle is in motion.

Although the invention has been explained in relation to its preferred embodiment, it is to be understood that many other possible modifications and variations can be made without departing from the spirit and scope of the invention as hereinafter claimed.

What is claimed is:

1. A hydro cycle, comprising:
a floatation element;
a frame;
a seat;
a paddle wheel;
a compression channel;
a steering mechanism;
the frame mounted to the floatation element;
the seat mounted to the frame;
the paddle wheel mounted to the floatation element;
the compression channel mounted to the floatation element;
the paddle wheel traversing the compression channel; and
the steering mechanism mounted to the floatation element.

2. The hydro cycle of claim 1, further comprising:
a set of pedals;
a set of front sprockets, comprising a left front sprocket and a right front sprocket;
a set of rear sprockets, comprising a left rear sprocket and a right rear sprocket;
a set of chains, comprising a left chain and a right chain;
the set of front sprockets mounted to the frame;
the set of pedals connected to the set of front sprockets;
the set of rear sprockets mounted to the paddle wheel;
the left chain connecting the left front sprocket and the left rear sprocket; and
the right chain connecting the right front sprocket and the right rear sprocket.

3. The hydro cycle of claim 2, wherein the set of pedals further comprises a set of crank arms.

4. The hydro cycle of claim 1, wherein the compression channel further comprises:
a set of front scoops;
a set of lateral braces; and
a set of tail pinches.

5. The hydro cycle of claim 1, wherein the paddle wheel further comprises:
a paddle wheel frame;
a plurality of propulsion cups; and
the plurality of cups mounted to a perimeter of the paddle wheel.

6. The hydro cycle of claim 5, wherein the plurality of propulsion cups further comprise a plurality of expulsion vents.

7. The hydro cycle of claim 1, wherein the steering mechanism further comprises:
a steering column;
a handlebar;
a rudder;
the steering column traversing the floatation element;
the handlebar mounted to the steering column; and
the rudder mounted to the steering column.

8. The hydro cycle of claim 7, wherein the rudder further comprises a swivel float.

9. The hydro cycle of claim 1, further comprising a pontoon gear.

10. The hydro cycle of claim 8, wherein the pontoon gear further comprises:
a pontoon gear frame;
a left pontoon;
a right pontoon;
the pontoon gear frame connected to the steering mechanism;
the left pontoon gear mounted to the pontoon gear frame; and
the right pontoon gear mounted to the pontoon gear frame.

11. The hydro cycle of claim 1, wherein the floatation element further comprises:

a wheel well;

a tail shield;

the paddle wheel disposed within the wheel well; and the tail shield disposed on an aft portion of the floatation element.

12. A hydro cycle, comprising:

a floatation element;

a frame;

a seat;

a paddle wheel;

a plurality of propulsion cups;

a compression channel a steering mechanism;

a set of pedals;

a front sprocket;

a rear sprocket;

a chain;

the frame mounted to the floatation element;

the seat mounted to the frame;

the paddle wheel mounted to the floatation element;

the plurality of propulsion cups mounted to a perimeter of the paddle wheel;

the compression channel mounted to the floatation element;

the paddle wheel traversing the compression channel;

the steering mechanism mounted to the floatation element;

the set of pedals mounted to the frame;

the front sprocket connected to the set of pedals;

the rear sprocket connected to the paddle wheel; and the chain connecting the front sprocket to the rear sprocket.

13. The hydro cycle of claim 12, wherein the compression channel further comprises:

a set of front scoops;

a set of lateral braces; and a set of tail pinches.

14. The hydro cycle of claim 12, wherein the plurality of propulsion cups further comprise a plurality of expulsion vents.

15. The hydro cycle of claim 12, wherein the steering mechanism further comprises:

a steering column;

a handlebar;

a rudder;

the steering column traversing the floatation element;

the handlebar mounted to the steering column; and the rudder mounted to the steering column.

16. The hydro cycle of claim 15, wherein the rudder further comprises a swivel float.

17. The hydro cycle of claim 15, further comprising:

a pontoon gear frame;

a left pontoon;

a right pontoon;

the pontoon gear frame connected to the steering mechanism;

the left pontoon mounted to the pontoon gear frame; and the right pontoon mounted to the pontoon gear frame.

18. A hydro cycle, comprising:

a floatation element;

a frame;

a seat;

a set of pedals;

a set of front sprockets;

a set of rear sprockets;

a set of chains;

a paddle wheel;

a plurality of propulsion cups;

a compression channel;

a steering mechanism;

the frame mounted to the floatation element;

the seat mounted to the frame;

the set of pedals mounted to the frame;

the set of front sprockets connected to the set of pedals;

the paddle wheel mounted to the floatation element;

the plurality of propulsion cups mounted to the paddle wheel;

the set of rear sprockets connected to the paddle wheel;

the set of chains connected the set of front sprockets and the set of rear sprockets;

the compression channel mounted to the floatation element;

the paddle wheel traversing the compression channel; and the steering mechanism mounted to the floatation element.

19. The hydro cycle of claim 18, wherein the compression channel further comprises:

a set of front scoops;

a set of lateral braces; and a set of tail pinches.

20. The hydro cycle of claim 18, wherein the steering mechanism further comprises:

a steering column;

a handlebar;

a swivel float;

the steering column traversing the floatation element;

the handlebar mounted to the steering column; and the swivel float mounted to the steering column.

* * * * *